United States Patent [19]

Chasseray

[11] Patent Number: 4,859,132

[45] Date of Patent: Aug. 22, 1989

[54] PROCESS AND DEVICE FOR OPENING BY THE MEDIAN ZONE OF THEIR BODIES, EMPTYING AND FLATTENING HERMETICALLY CLOSED METAL OR COMPOSITE CONTAINERS

[76] Inventor: Yves Chasseray, 56 Boulevard de Dezerseul, 35510 Cesson Sevigne, France

[21] Appl. No.: 50,127

[22] PCT Filed: Jul. 31, 1986

[86] PCT No.: PCT/FR86/00271

§ 371 Date: Apr. 14, 1987

§ 102(e) Date: Apr. 14, 1987

[87] PCT Pub. No.: WO87/01094

PCT Pub. Date: Feb. 26, 1987

[30] Foreign Application Priority Data

Aug. 14, 1985 [FR] France ..... 85 12397

[51] Int. Cl.[4] ..... B30B 9/00

[52] U.S. Cl. ..... 414/412; 222/87; 100/98 R; 100/902; 83/620; 414/786

[58] Field of Search ..... 414/412, 786; 222/87; 83/620; 100/98 R, 902

[56] References Cited

U.S. PATENT DOCUMENTS

| | | | |
|---|---|---|---|
| 2,067,555 | 1/1937 | Walker | 100/98 R |
| 2,369,305 | 2/1945 | Lobasso | 100/98 R |
| 2,591,510 | 4/1952 | Clark | 100/98 R |
| 2,958,273 | 11/1960 | Morrow | 100/98 R |
| 3,682,341 | 8/1972 | Happel | 414/412 |
| 3,835,768 | 9/1974 | Kidson | 222/87 X |
| 3,993,221 | 11/1976 | Boynton et al. | 222/87 |
| 4,334,469 | 6/1982 | Tanner et al. | 100/98 R X |
| 4,396,340 | 8/1983 | Clinton | 414/412 |
| 4,459,906 | 7/1984 | Cound et al. | 222/87 X |
| 4,573,852 | 3/1986 | Rinfret et al. | 414/412 |

FOREIGN PATENT DOCUMENTS

| | | | |
|---|---|---|---|
| 3002083 | 7/1981 | Fed. Rep. of Germany | 414/412 |
| 1480008 | 5/1967 | France | 100/98 R |
| 70995 | 4/1983 | Japan | 100/902 |
| 7612597 | 2/1978 | Netherlands | 414/412 |
| 1234287 | 5/1986 | U.S.S.R. | 414/412 |

*Primary Examiner*—Frank E. Werner

*Attorney, Agent, or Firm*—Sughrue, Mion, Zinn, Macpeak & Seas

[57] ABSTRACT

Mounted in a frame are: (a) a hopper having at its base an opening and slots delimiting optionally articulated, inclined and vertical walls which open into the opening; (b) an inclined conveyor or chute for supplying the hopper with containers through a lock; and (c) a tool controlling one or a plurality of knives for cutting the container, which tool is mounted in the frame so as to be displaced against the containers and is provided with a manual actuator, the knife having a contour adapted to the shape of the containers and being positioned so as to partly and transversely sever the containers in the medial region of their bodies; (d) the tool including a ram for opening and flattening the containers against the inclined walls of the hopper, after the containers have been cut by the knife, while causing the containers to be emptied into a receptacle placed under the hopper.

7 Claims, 5 Drawing Sheets

PROCESS AND DEVICE FOR OPENING BY THE MEDIAN ZONE OF THEIR BODIES, EMPTYING AND FLATTENING HERMETICALLY CLOSED METAL OR COMPOSITE CONTAINERS

BACKGROUND OF THE INVENTION

The present invention relates to a process and device for opening, emptying and flattening in a single operation hermetically closed, preferably cylindrical, metal or composite containers.

It is known that the opening of this type of containers, in particular preserved food cans, is traditionally effected by cutting one of the bottoms or lids around the formed-over rims, which is slow and dangerous, since the edges of the lids or of the formed-over rims become sharp and there is a risk of injuring the operator.

Further, the empty containers which become bulky are, up to the present time, discharged, either by voluminous garbage bins or containers, or taken for the purpose of crushing them in waste product presses or crushers which are expensive and require handlings, time and energy.

SUMMARY OF THE INVENTION

The object of the present invention is to eliminate these drawbacks by proposing a process and a device whereby it is possible to carry out in a single operation, the opening, the emptying and the flattening of the containers with no risk of injury to the user, this device being capable of being used by individuals, craftsmen, industrials and collectivities such as restaurants.

According to the invention, the process is characterised in that the containers are partly severed in the median zone of their bodies by leaving between their two halves a retaining strip, these two halves are deformed while opening them downwardly so as to empty them before flattening them, and the crushed containers are ejected after their contents are received in a receptacle.e Thus, contrary to that which was carried out up to the present time, the invention provides for the opening of the containers, no longer by one of their bottoms, but by the median zone of their body.

According to the invention, the device for carrying out this process is characterised in that it comprises, mounted in a fixed support frame:

(a) a hopper provided at its base with an opening and passageways defining vertical and convergent inclined planes and opening onto this opening;

(b) means for feeding the hopper with containers through a lock, for example a chute so that each container can bear in succession by its ends on the inclined walls of the hopper and above said opening;

(c) a tool provided with at least one cutter for cutting the container, mounted in the frame in such manner as to be movable against the successive containers and equipped with driving means, the cutter having a contour adaptable to the diameter of the containers, and being positioned in such manner as to partly sever the latter transversely in the median zone of their body;

(d) and means for opening and then flattening the containers after their severing by the cutter while producing their emptying into a receptacle placed under the hopper.

Thus, as the cutter or cutters for severing the containers move inside the frame of the device out of reach of the user, any risk of injury to the latter is avoided.

Further, the flattening or crushing of the containers following on their emptying is carried out with no particular handling and no risk of accident for the user.

Lastly, the flattening of the containers after their emptying solves the problems of bulkiness encountered up to the present time while avoiding the necessity of, as the case may be, costly crushers or scrap presses.

Other features and advantages of the invention will be apparent from the following description with reference to the accompanying drawings which illustrate by way of non-limiting examples several embodiments thereof.

FIGS. 4–4F and 5–5F are diagrammatic elevational views respectively in two perpendicular planes of a sequence of opening, emptying, crushing and ejection of a container by means of the device of FIGS. 1 to 3;

FIGS. 7–7E and 8–8E are diagrammatic elevational views similar to FIGS. 4 and 5 and illustrating a sequence of operation of a second embodiment of the invention;

FIGS. 9–9D and 10–10D are views similar to FIGS. 4 and 5 illustrating the sequence of operation of a third embodiment of the device according to the invention.

Figure 1:
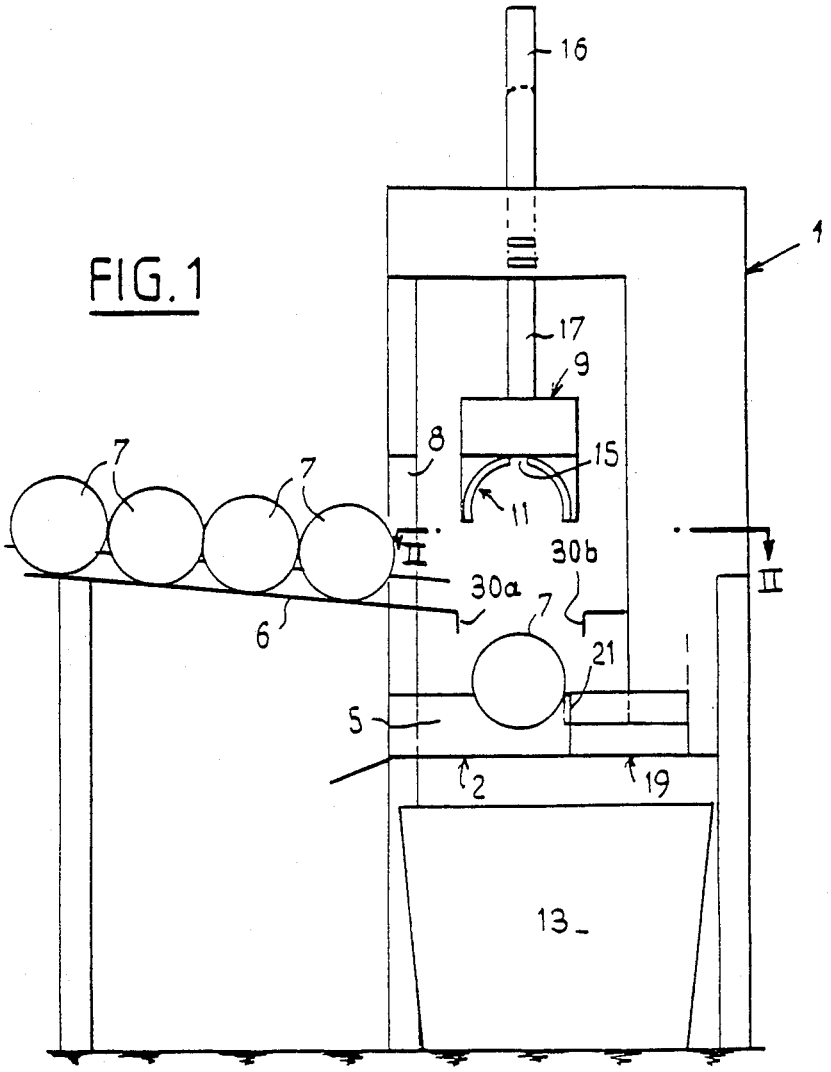
FIG. 1 is a diagrammatic side elevational view of an embodiment of the device according to the invention for opening, emptying and flattening containers.

The device represented in the drawings is adapted to open, empty and flatten in a single operation hermeticalled closed, preferably cylindrical, metal or composite containers, in particular preserved food cans, and may be employed for both household purposes and artisinal or industrial purposes.

This device comprises, mounted in a fixed support 1:

(a) a hopper 2 provided at its base with an opening 3 and passageways 4 defining convergent inclined planes 5 and vertical planes 20 and opening onto this opening. In the described example, the inclined planes 5 are fixed;

(b) a chute or conveyor belt 6 feeding the hopper 2 with containers 7 through a lock 8 mounted in the frame 1, so that each container 7 can bear in succession by its ends on the inclined planes 5 and above the opening 3;

(c) a tool 9 provided with one or more cutters 11 for cutting the containers 7, mounted in the frame 1 in such manner as to be capable of being displaced against the successive containers 7 and equipped with driving means, the cutter 11 having a contour which adapts itself to the diameter of the containers 7 (therefore semi-circular for cylindrical containers such as 7) and being so positioned as to be capable of partly severing the latter transversely in the median zone of their body;

(d) and means for opening and then flattening the containers 7 after the cutting thereof by the cutter 11 while causing the emptying thereof into a receptacle 13 placed under the hopper 2.

The chute 6 is provided at its end with a downwardly inclined flange 30*a* which, with three other L-sectioned members 30*b*, 30*c*, 30*d* fixed inside the frame 1, constitute guides positioning the containers 7 on the inclined planes 5.

The tool 9 is in the form of a ram 9 and comprises two identical parts each extending over a little more than a quarter of a circle. In its upper part, the cutter 11 is provided with a non-cutting flat portion 15 between the two sharp sections so as to leave a strip for retaining the two halves of the container 7 together after the cutting of the latter.

Figure 2:
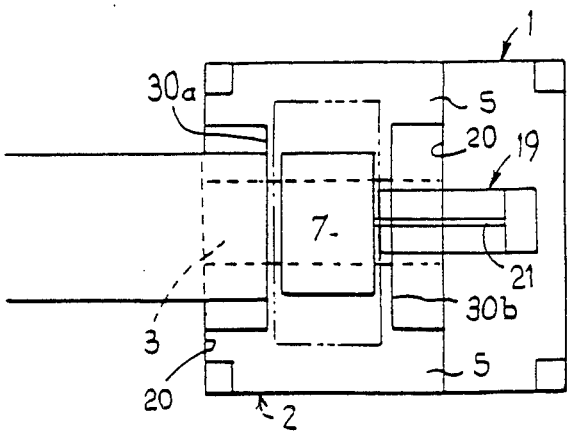
FIG. 2 is a cross-sectional view taken on line II—II of FIG. 1.
Figure 3:
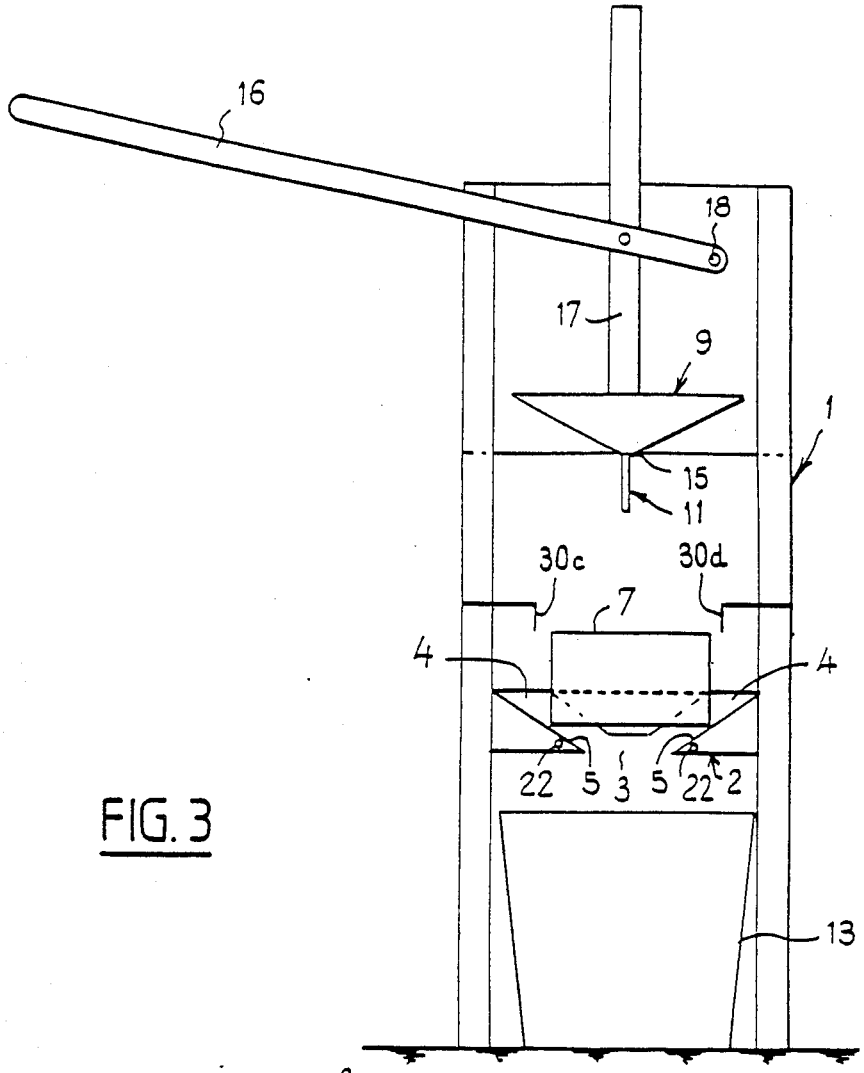
FIG. 3 is an elevational view of the device in a plane perpendicular to that of FIG. 1.
Figure 6:
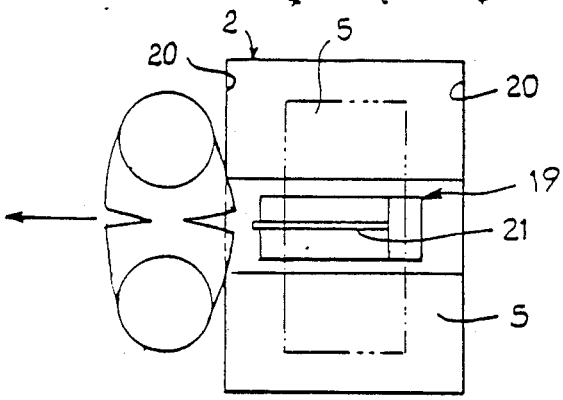
FIG. 6 is a top plan view of the hopper of the device of FIGS. 1 to 3 illustrating the stage of the ejection of an opened, flattened and emptied container.
Figure 4:
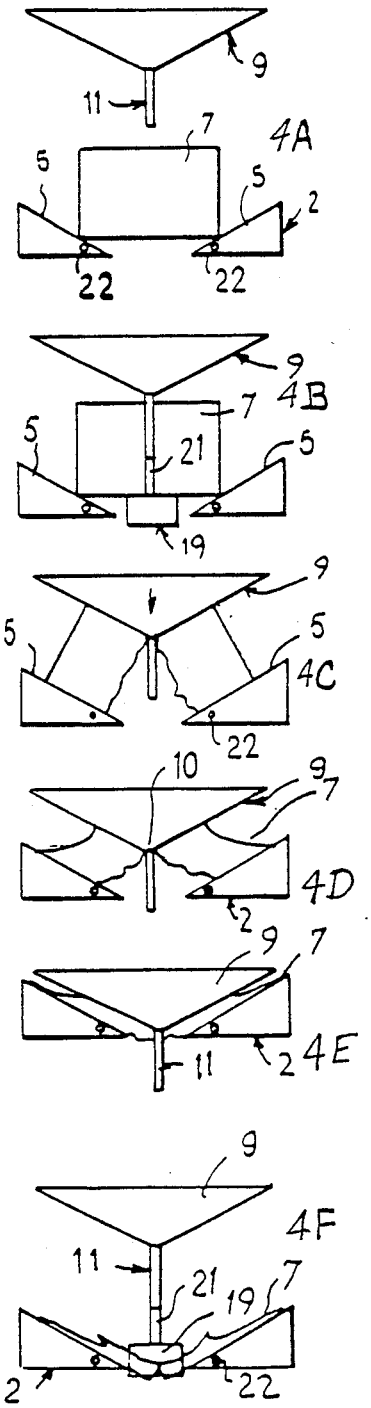
Figure 5:
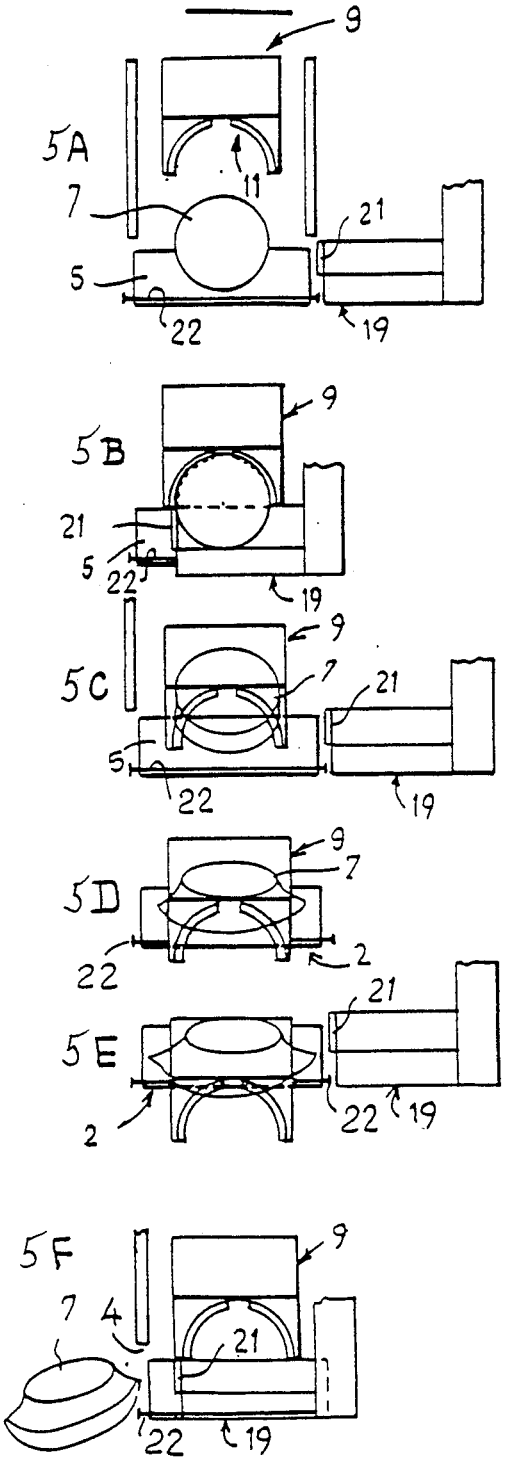
Figure 7:
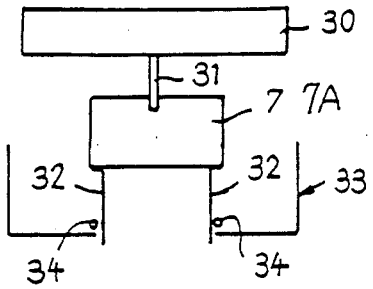
Figure 7:
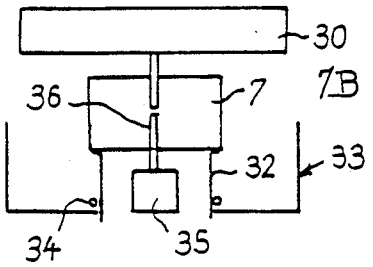
Figure 7:
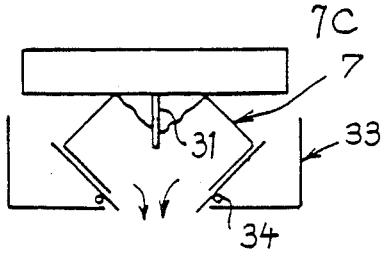
Figure 7:
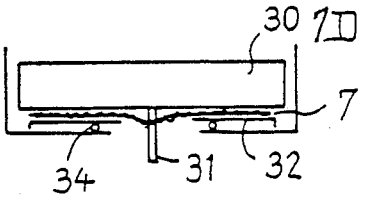
Figure 7:
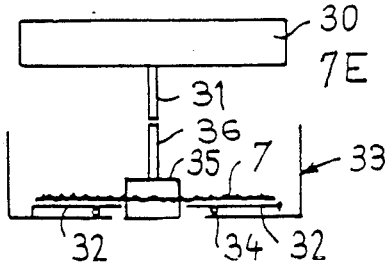
Figure 8:
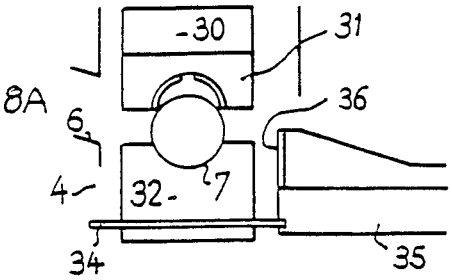
Figure 8:
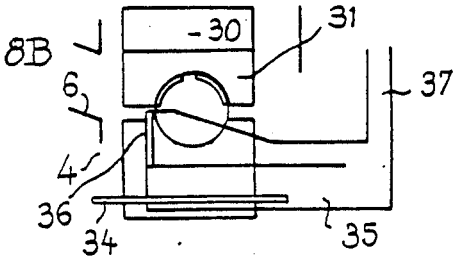
Figure 8:
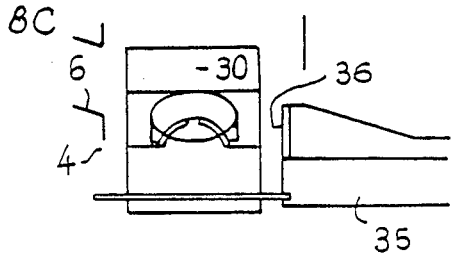
Figure 8:
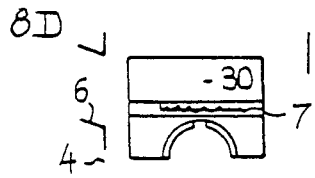
Figure 8:
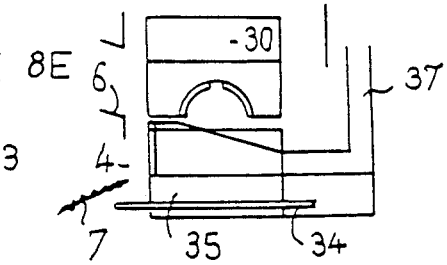
Figure 9:
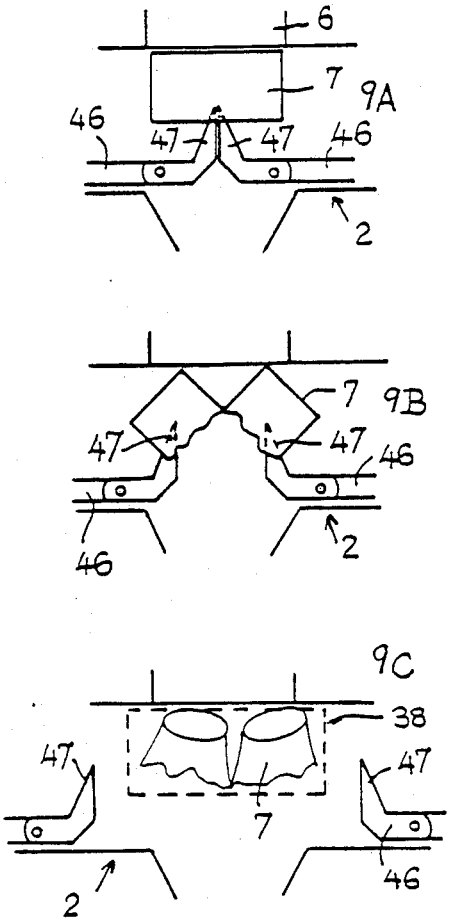
Figure 10:
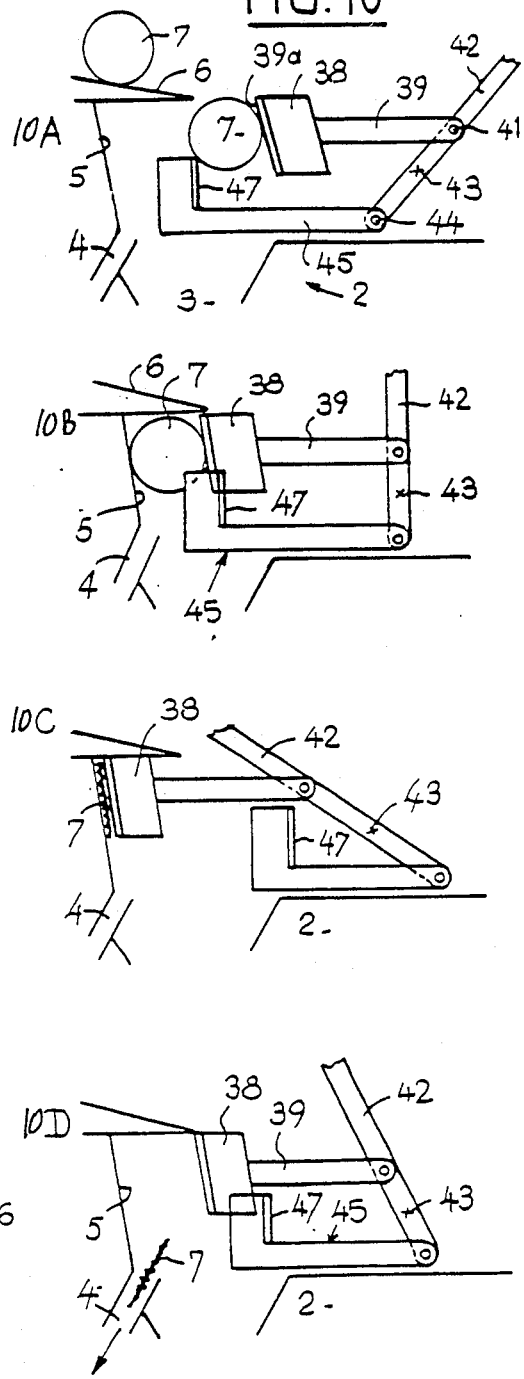

In the example represented in FIGS. 1 to 3, the means for actuating the cutter 11 comprise a manual lever system 16 which is articulated, on one hand, on an arm 17 mounted in the central part of the frame 1, and, on the other hand, on the frame 1 at 18. This manual system may be replaced by any other equivalent means, for example one or more mechanical, electric, pneumatic or hydraulic systems, particularly suitable if the apparatus must be used on an industrial scale or by collectivities.

The device also comprises an ejector 19 located at the level of the bottom of the hopper 2 and its opening 3 and horizontally slidable therein so as to eject the completely flattened container 7 and after the rising of the cutter 11. The ejector 19 may be, as the case may be, provided with one or more cutters 21 arranged to be capable of contributing to the cutting and to the opening of the container 7 simultaneously with the actuation of the cutter 11, the ejector 19 being, for this purpose, advanced into the opening 3 in synchronization with the displacement of the ram 9.

The chute or conveyor belt 6 for feeding containers 7 to be opened may act as an accumulation table while the lock 8 is adjustable to the format of the containers by permitting the passage to the interior of the frame or safety housing 1 of only one container at a time. The cutter 11 is adapted to form a circular lateral cut on the major part of the perimeter of the container 7 while leaving an uncut strip in the uncut region of the perimeter corresponding to the flat portion 15.

The hopper 2 is formed by, in addition to the two walls 5, two vertical lateral walls 20 in which are provided the passageways 4, the opening 3 extending throughout the length of the inclined walls 5.

The cycle of operation of this device employing the process of the invention is the following (FIGS. 4A–4F and 5A–5F).

FIGS. 4A and 5A: the lock 8 having been raised to allow the introduction of a container 7 in the hopper 2 between the guide 30*a*–30*d* bearing against the inclined walls 5, then closed in order to maintain the following container 7 in a standby situation, the user actuates the lever 16 in order to lower the ram 9 whose cutter 11 comes to bear against the median zone of the container 7 which it severs in a little more than one half of its circumference. Meanwhile, the ejector 19 is maintained out of the hopper 2 in the retracted position.

FIGS. 4B and 5B: the cutter 11 remaining in its position, the ejector 19 is advanced toward the container 7 and its cutter (s) 21 severs the lower part of the container 7 not cut by the cutter 11. Then the ejector 19 and its cutter (s) 21 are retracted to their initial position while contributing to spread apart into two parts the container 7 which opens.

FIGS. 4C and 5C: the lowering of the ram 9 and its cutter 11 toward the bottom of the hopper 2 is continued so that the ram 9 deforms the container 7 whose two halves are only retained by a strip 10 and are progressively deformed, after which the contents of the container 7 are emptied into the receptacle 13 through the opening 3 (FIGS. 4D and 5D).

At the end of the downward travel of the ram 9, the latter is almost completely engaged with the walls 5 owing to its profile which is complementary to that of said walls, while crushing the container against the latter (FIGS. 4E and 5E).

During the deformation and flattening of the container, the two parts of the latter remain held together by the uncut central strip 10.

Then the operator raises the tool 9 by pivoting the lever 16 while, in synchronism with this raising of the tool 9 (FIGS. 4F and 5F), the ejector 19 is advanced and urges the crushed container through the passageways (4) toward a recovering receptacle (not shown), outside the frame 1. The ram 9 is brought back to its initial position, which permits the automatic entry through the lock 8 of a new container 7 for a new work cycle.

When the device is used for opening preserved food cans, and although only the cutters 11, 21 may come into a very limited contact with the contents of the cans, at least the walls 5 and the base of the ram 9 are made from materials termed "food" materials.

The lower cutter 21 could be eliminated and replaced by any other equivalent element permitting the completion of the opening of the container 7 into two halves to permit their emptying. The containers may also not be cylindrical and the cutter(s) then have a contour adapted to the containers, for example oblique, for parallelepipedic containers.

According to a second embodiment of the invention (FIGS. 7A–7E and 8A–8E), the walls 5 are articulated about horizontal shafts 22 (also seen in FIGS. 4 and 5) and are connected by a link (not shown) to the lever 16 to ensure their raising to their initial position simultaneously with the raising of the ram 13 after ejection of a flattened container. This link connecting system is known per se and has not been shown, in order to simplify the drawing. Thus, when the ram 30 approaches a container 7, then comes into contact with the latter and starts the opening thereof with its cutter 31, the pressure exerted on the walls 5 causes them to swing about the shafts 22 and these walls reach in this way a practically horizontal position where they come to bear against the base of the hopper 2. It will be understood that, in order to permit this swinging, the upper ends of the walls 5 are truncated relative to the walls seen in FIGS. 1 to 3. Thus, the container is flattened between the walls 5 and the lower surface of the ram 30;

The ejector 35 is provided with a cutter 36 and connected by an element 37 to the system controlling the tool 30 (lever 16).

The sequence A, B, C, D, E illustrates the successive stages of the opening, the flattening and the emptying of a container 7. In the position A, the cutter 31 comes into contact with the container 7, the articulated walls or flaps 32 being raised. In the stage B, the container 7 is opened by the cutters 31 and 36, then the force exerted by the tool 30 on the two halves of the container 7 is transmitted to the articulated walls 32 which spread apart from each other and swing about the shafts 34, while the container is emptied. Then (stages C-D), the container 7 is progressively flattened between the flaps 32 and the tool 30, the flaps 32 are completely swung about the shafts 34 and the container 7 is completely flattened between said flaps 32 and the tool 30, and finally, in stage E, the ejector 35 ejects the flattened container 7.

In the third embodiment illustrated in FIGS. 9A–9D and 10A–10D 10, the tool 38 is mounted in such manner as to be horizontally displaceable (whereas the tool of the two preceding embodiments is displaced vertically) and is fixed to a support 39 articulated at 41 to a control lever 42 which is itself articulated about a horizontal shaft 43. The end of the lever 42 is articulated about a horizontal shaft 44 on the end part of an ejector 45 constituted by two arms 46 each equipped with an end cutter 47.

In the initial stage A, the container 7 which has dropped from the chute 6, is maintained between the cutter 39*a* of the tool 38, and the cutters 47. When the lever 42 is swung about the shaft 43 in the counterclockwise direction (arrow in FIG. 10B), this swinging causes the tool 38 to be advanced, which opens by its middle part the container 7, and the simultaneous retraction of the ejector 45 whose cutters 47 complete the opening of the container. In stage B, the latter is urged by the tool 38 against the inclined wall 5, while the two arms 46 of the ejector 45 are opened and the container 7 is emptied.

In stage C, the tool 38 has continued its advance, while the arms 46 of the ejector 45 continue to spread apart and retract, and the container 7 is flattened between the tool 38 and the wall 5. The ejector 45 is completely retracted, the control lever 42 being in its maximum inclined position. In the final stage D, the lever 42 swings in the opposite direction and progressively returns the tool 38 to its initial position, and the completely flattened container 7 slides through the discharging opening 4, while the contents of the container are emptied into the receptacle 13.

I claim:

1. A device for successively opening, emptying and flattening, in a single operation, hermetically closed metal or composite filled containers, characterized in that it comprises, mounted in a fixed support frame (1):

(a) a hopper (2) provided at its base with an opening (3) and passageways (4) defining convergent inclined walls (5) and vertical walls and opening into this opening (3);

(b) means (6) for feeding the hopper (2) with filled containers (7) through a lock (8), so that each container (7) can bear successively by its ends against the walls (5) of the hopper (2) and above said opening (3); and (c) a tool (9) provided with a cutter (11) for cutting the container, mounted in the frame (1) in such manner as to be displaceable against successive containers (7) and equipped with driving means (16, 17), the cutter (11) having a contour adapted to the shape of the containers and being positioned in such manner as to partly sever the latter transversely in their median zone;

said tool (9) also comprising means for flattening the severed containers (7), after their cutting by the cutter (11), upon said convergent inclined walls (5), while causing their emptying into a receptacle (13) placed under the hopper (2); and in that the cutter (11) is fixed under a ram (9) having a shape complementary to the shape of the inclined walls (5), so as to be capable of flattening the container (7) against the latter, at the same time as the two halves of said container are opened and emptied.

2. A device for opening, emptying and flattening hermetically closed metal or composite containers, characterised in that it comprises, mounted in a fixed support frame (1):

(a) a hopper (2) provided at its base with an opening (3) and passageways (4) defining convergent inclined walls (5) and vertical walls and opening into this opening (3);

(b) means (6) for feeding the hopper (2) with containers (7) through a lock (8), so that each container (7) can bear successively by its ends against the walls (5) of the hopper (2) and above said opening (3);

(c) a tool (9) provided with a cutter (11) for cutting the container, mounted in the frame (1) in such manner as to be displaceable against successive containers (7) and equipped with driving means (16, 17), the cutter (11) having a contour adapted to the shape of the containers and being positioned in such manner as to partly sever the latter transversely in their median zone;

(d) and means (9) for flattening the containers (7) after their cutting by the cutter (11), while causing their emptying into a receptacle (13) placed under the hopper (2); and further characterized in that the cutter (11) has in its upper part a flat non-cutting portion (15) so as to leave a strip (1) for retaining the two halves of the container (7) together after the cutting of the latter.

3. A device according to claim 2, characterised in that the cutter (11) is fixed under a ram (9) having a shape complementary to the shape of the inclined walls (5), so as to be capable of flattening the container (7) against the latter, at the same time as the two halves of said container are opened and emptied.

4. A device according to claim 3, characterised in that it comprises an ejector (19) located at the level of the bottom of the hopper (2) and slidable in the opening (3) of the latter so as to eject the completely flattened container (7) after the rising of the cutter (11).

5. A device according to claim 4, characterised in that the ejector (19) is provided with at least one cutter (21) adapted to be capable of completing the cutting of the container after the actuation of the cutter (11) mounted on the tool (9), the ejector (19) being for this purpose advanced into the opening (3) of the base of the hopper, after which the ejector (19) and its cutter (21) are retracted in order to permit the emptying and the crushing of the severed container.

6. A process for opening, emptying and flattening hermetically closed and preferably cylindrical containers (7), comprising the steps of: partly severing these containers in the median zone of their body, while leaving between their two halves a retaining strip (10); deforming these two halves while they are downwardly opened so as to empty them and crush them; and ejecting the crushed containers (7) after their contents have been received in a receptacle.

7. A device for opening, emptying and flattening hermetically closed metal or composite containers, characterised in that it comprises, mounted in a fixed support frame (1):

(a) a hopper (2) provided at its base with an opening (3) and passageways (4) defining convergent inclined walls (5) and vertical walls and opening into this opening (3);

(b) means (6) for feeding the hopper (2) with containers (7) through a lock (8), so that each container (7) can bear successively by its ends against the walls (5) of the hopper (2) and above said opening (3);

(c) a tool (9) provided with a cutter (11) for cutting the container, mounted in the frame (1) in such manner as to be displaceable against successive containers (7) and equipped with driving means (16, 17), the cutter (11) having a contour adapted to the shape of the containers and being positioned in such manner as to partly sever the latter transversely in their median zone;

(d) and means (9) for flattening the containers (7) after their cutting by the cutter (11), while causing their emptying into a receptacle (13) placed under the hopper (2); and further characterized in that the inclined walls (5) are articulated about horizontal shafts (22) and connected by control means to the driving means (16, 17) of the tool (9) so as to swing when the tool (9) cuts a container which is then flattened between the latter and said articulated walls (5), and to rise when the tool (9) is retracted.

* * * * *